US006769498B2

(12) United States Patent
Hughes

(10) Patent No.: US 6,769,498 B2
(45) Date of Patent: Aug. 3, 2004

(54) METHOD AND APPARATUS FOR INDUCING UNDER BALANCED DRILLING CONDITIONS USING AN INJECTION TOOL ATTACHED TO A CONCENTRIC STRING OF CASING

(75) Inventor: W. James Hughes, Tulsa, OK (US)

(73) Assignee: Sunstone Corporation, Oklahoma City, OK (US)

( * ) Notice: Subject to any disclaimer, the term of this patent is extended or adjusted under 35 U.S.C. 154(b) by 70 days.

(21) Appl. No.: 10/198,833

(22) Filed: Jul. 22, 2002

(65) Prior Publication Data

US 2004/0011561 A1 Jan. 22, 2004

(51) Int. Cl.[7] ..... E21B 21/12; E21B 17/18; E21B 17/22

(52) U.S. Cl. ..... 175/65; 175/215; 175/231; 175/310; 175/324

(58) Field of Search ..... 175/57, 65, 215, 175/231, 308, 310, 320, 323, 324

(56) References Cited

U.S. PATENT DOCUMENTS

| | | | | | |
|---|---|---|---|---|---|
| 2,622,684 | A | * | 12/1952 | Kluck | 166/241.6 |
| 4,223,747 | A | * | 9/1980 | Marais | 175/65 |
| 4,512,420 | A | | 4/1985 | Hayatdavoudi et al. | |
| 4,630,691 | A | * | 12/1986 | Hooper | 175/65 |
| 4,832,577 | A | | 5/1989 | Avramidis | |
| 4,984,633 | A | * | 1/1991 | Langer et al. | 166/241.1 |
| 5,040,620 | A | * | 8/1991 | Nunley | 175/61 |
| 5,150,757 | A | * | 9/1992 | Nunley | 175/323 |
| 5,707,214 | A | | 1/1998 | Schmidt | |
| 5,911,285 | A | * | 6/1999 | Stewart et al. | 175/317 |
| 6,138,777 | A | * | 10/2000 | Fraim et al. | 175/92 |
| 2003/0146001 | A1 | * | 8/2003 | Hosie et al. | 166/369 |

* cited by examiner

*Primary Examiner*—David Bagnell
*Assistant Examiner*—Jennifer H Gay
(74) *Attorney, Agent, or Firm*—William S. Dorman

(57) ABSTRACT

A method and apparatus for under balanced drilling comprising a production casing extending vertically from the ground to the area where the drilling is taking place, a concentric casing mounted within the production casing and forming therewith an outer annulus, a concentric casing connecting at its lower end with an upper end of an injection tool, the injection tool having a lower end connecting with a packer assembly which includes a packer and slips, and a drill string having a drill bit at the lower end thereof extending downwardly through the concentric casing, the injection tool, and packer assembly to the area where the drilling is taking place, the injection tool having a generally cylindrical body and a plurality of spaced spiral flutes extending outwardly from the cylindrical body to the inner wall of the production casing and forming therebetween spiral openings through which fluid may be forced downwardly through the outer annulus and against the packer, each flute having an upwardly directed spiral passageway, the space between the drill pipe and the concentric casing forming an inner annulus for the return of drilling fluid, gas, oil, water, mud and cuttings from the drilling area upwardly to the ground, the fluid material coming down through the outer annulus going upwardly through the spiral passageways and generating a vortex where the passageways merge with the inner annulus so as to force the drilling mud, oil, gas, water and cuttings upwardly through the inner annulus, drilling mud being provided through a central bore in the drilling pipe to go downwardly into the area where the drilling is taking place.

4 Claims, 6 Drawing Sheets

METHOD AND APPARATUS FOR INDUCING UNDER BALANCED DRILLING CONDITIONS USING AN INJECTION TOOL ATTACHED TO A CONCENTRIC STRING OF CASING

BACKGROUND OF THE INVENTION

1. Field of Invention

The method and apparatus of the present invention relates to an improved process to induce under balanced conditions by gas lifting fluids from a vertical or non-vertical well bore while drilling.

2. The Prior Art

An under balanced drilling condition exists when the hydrostatic pressure exerted by fluids in the well bore is less than the pore pressure contained within the reservoir being drilled. This low-pressure environment permits formation fluids such as oil and gas to enter the well bore while drilling. The under balanced state can be achieved by injecting a density reducing agent such as gas into the column of fluid near the bottom of the well where it combines with the fluids, both drilling and production, contained in the well bore causing a reduction in the fluid density. This gasified liquid reduces the density of the fluid which in turn lowers the hydrostatic pressure exerted by the fluid column to a point that can be less than the pressure residing within a formation thereby allowing oil, gas and water to be produced while drilling. Under balanced techniques are usually applied when drilling under pressured reservoirs.

SUMMARY OF THE INVENTION

The present invention improves the ability of a gas delivery system commonly known as the concentric casing technique to not only inject gas into the fluid but actually pump and lift fluids from a well by creating a venturi pump and vortex around the drill pipe. The apparatus includes a production casing extending vertically from the ground to the area where the drilling is taking place. A concentric casing is mounted within the production casing to form an outer annulus. The drill string extends downwardly through the concentric casing and terminates with a drill bit, which is located in the area where the drilling is to take place. The drill string connects with an injection tool, which in turn connects with a packer. The packer isolates the outer annular space between the production casing and the concentric casing thereby directing compressed gas to travel down the well to the packer. The injection tool includes a generally cylindrical body with a plurality of flutes or vanes which extend out to the inner circumference of the production casing so as to permit fluid coming down the concentric annulus to go between the flutes and past the injection tool until it reaches the packer. The spiral flutes or vanes of the injection tool are provided with longitudinal passageways, each of which is in the shape of an elongated venturi. When fluid (gas) passes beyond the injection tool and against the packer, it has only one place to go and that is through the spiral venturi passageways in the flutes and into the inner annulus between the concentric casing string and the drill pipe. This space is also referred to as the return annulus because it provides a path for drill cuttings, oil, gas, and water to be recovered from the well. The passageways leading to the nozzles spirals upwards causing a vortex to be generated when the gas enters the inner annulus. This allows the injected gas to more completely mix with the well bore fluids and thus prevent the compressed gas from separating and channeling through the fluids in the return annulus. This injection process, which can be described as an aspiration, also creates a pressure differential in the return annulus as the compressed gas passes through the nozzle orifice. This helps to draw the fluids upwards from the lower part of the well bore thereby assisting in the recovery of well bore fluids during the drilling process.

DETAILED DESCRIPTION OF THE PREFERRED EMBODIMENTS

Figure 1:
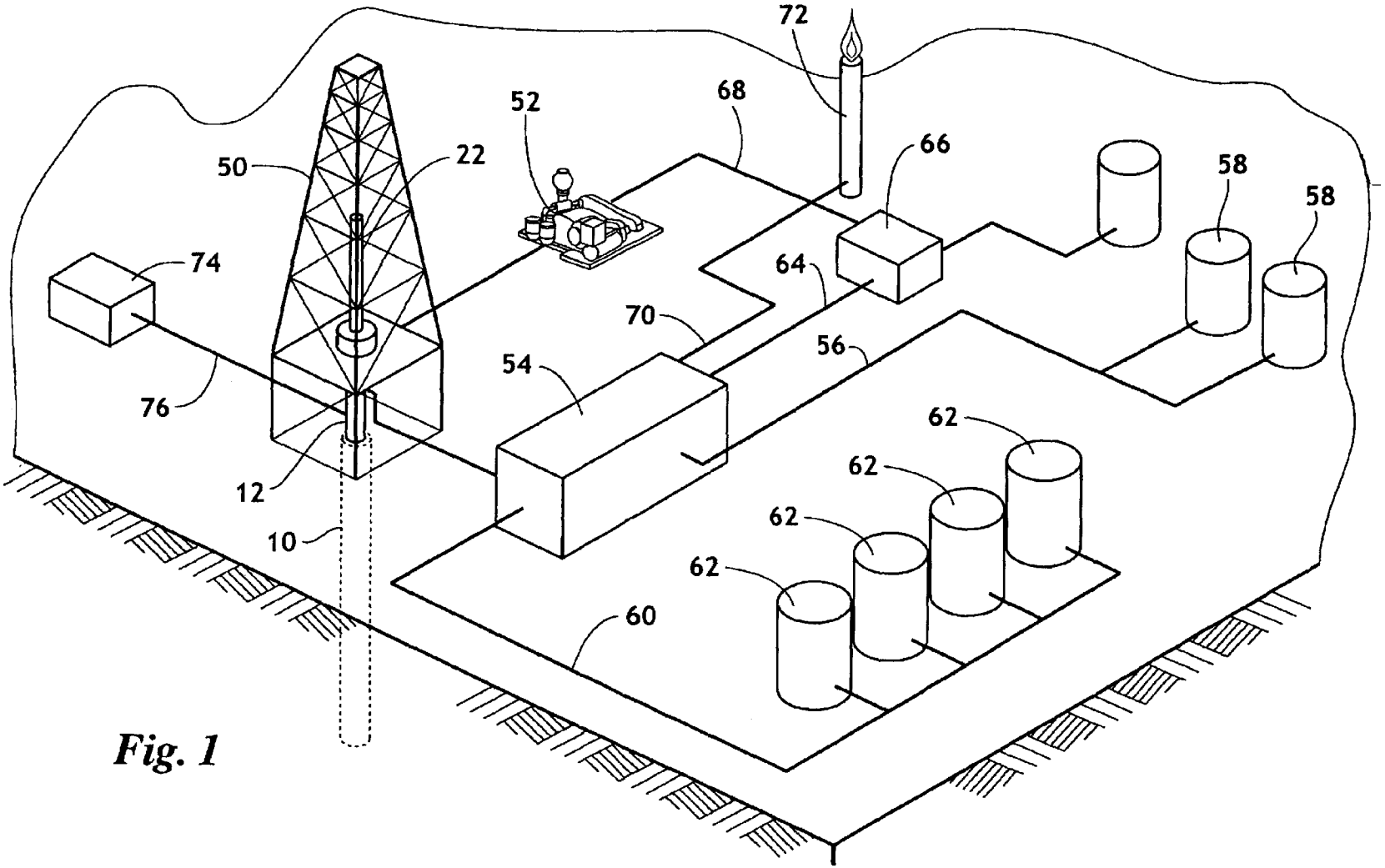
FIG. 1 is a diagrammatic and perspective view of a drilling rig employing the injection tool of the present invention and connected to various tanks, vessels, etc. for controlling flow of fluid into and out of the drilling rig.
Figure 2:
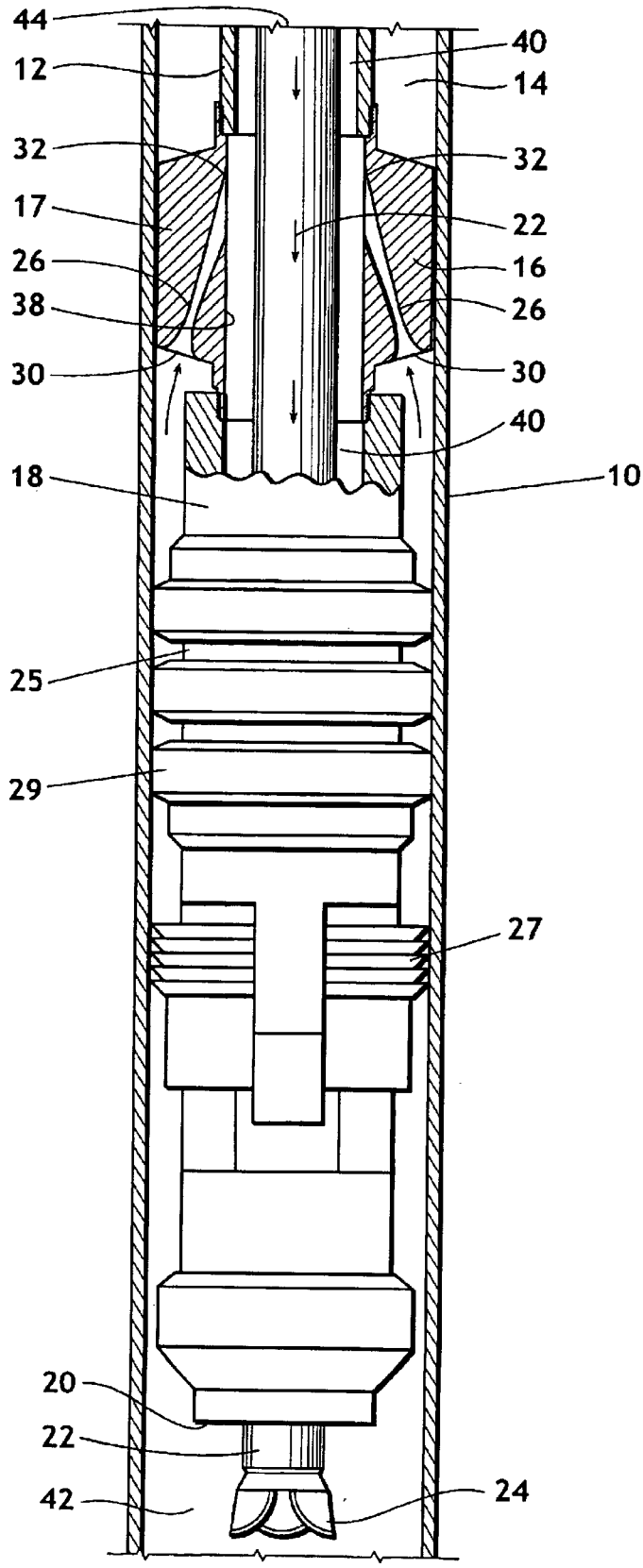
FIG. 2 is a longitudinal sectional view through a drill pipe arrangement employing the injection tool in combination with a production casing, a concentric casing, and the drill pipe itself.

Referring to the drawings in detail, FIG. 2 shows an (outer) production casing 10, an (inner) concentric casing 12 which is positioned within the production casing and forming therewith an outer annulus 14. An injection tool 16 (later to be described) connects with the bottom of the concentric casing 12 and with an assembly 18 (later to be described) which extends for some distance down through the production casing, and terminating in an opening 20 through which a drill pipe 22 protrudes. A drill bit 24 is positioned at the bottom of the drill pipe 22. At the upper portion of FIG. 2, the drill pipe 22 is shown as extending down through the concentric casing 12.

The assembly 18 which connects with the bottom of the injection tool 16 includes a plurality of conventional drilling items which need not be discussed in greater detail, except to point out that a packer 25 is positioned at the top of the assembly and prevents fluid coming down through the annulus 14 from going past the packer. The assembly 18 also includes conventional slips 27 which lock the assembly 18 in position when there is an upward pull on the concentric casing 12. At the time of the upward pull, the rubber elements 29 of the packer 26 will also be compressed and expand outwardly to form a seal against the inside of the production casing 10. Fluid coming down the annulus 14 cannot get past the packer 25. Thus, the fluid must reverse position and go upwardly toward the injection tool 16. The passageways 26 are shaped in the form of a venturi and serve as an orifice to permit gases passing through the passageway to expand when they reach the inner annulus 40 (later to be described).

Figure 3:
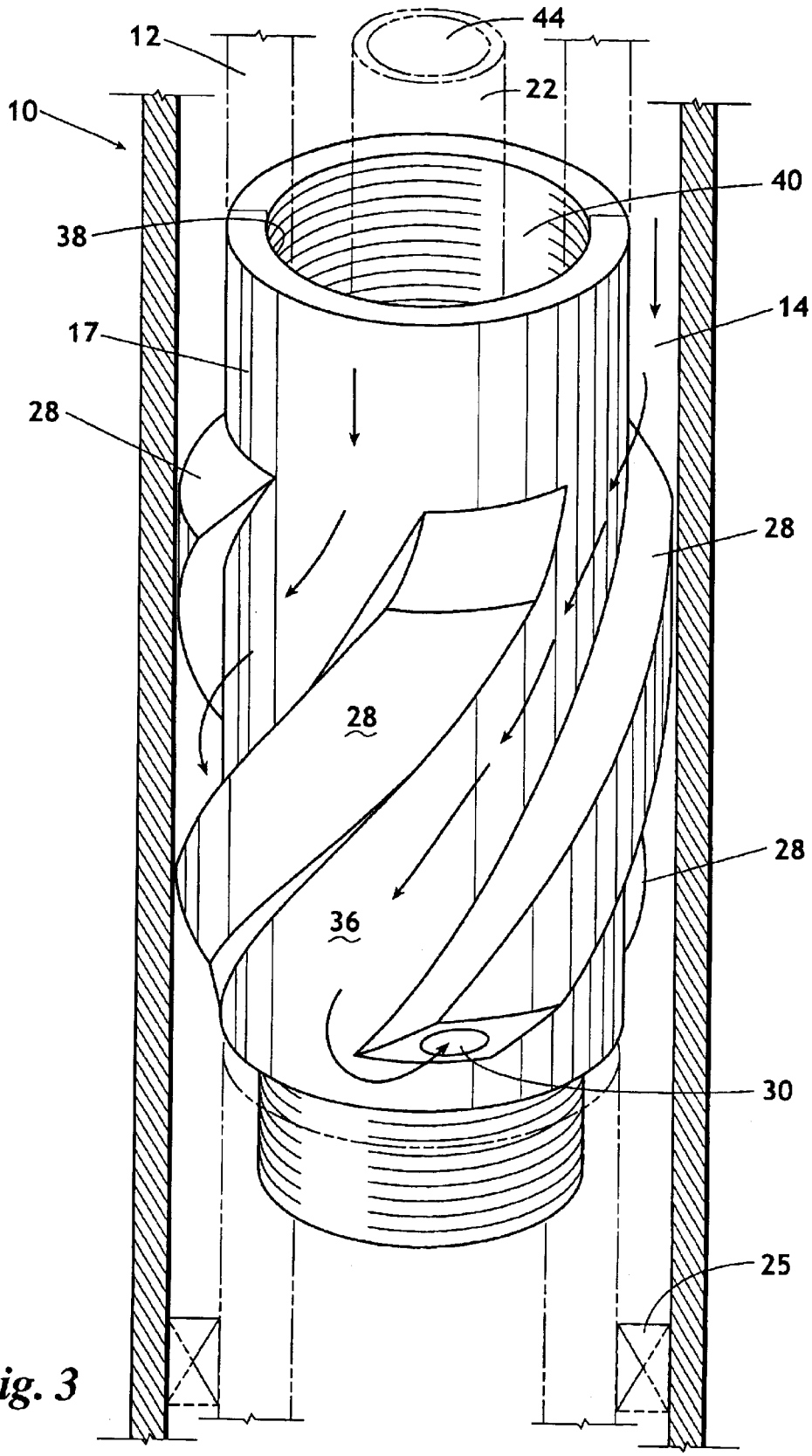
FIG. 3 is a longitudinal sectional view on a slightly enlarged scale representing the upper portion of FIG. 2 and showing the injection tool in a perspective relation.
Figure 4:
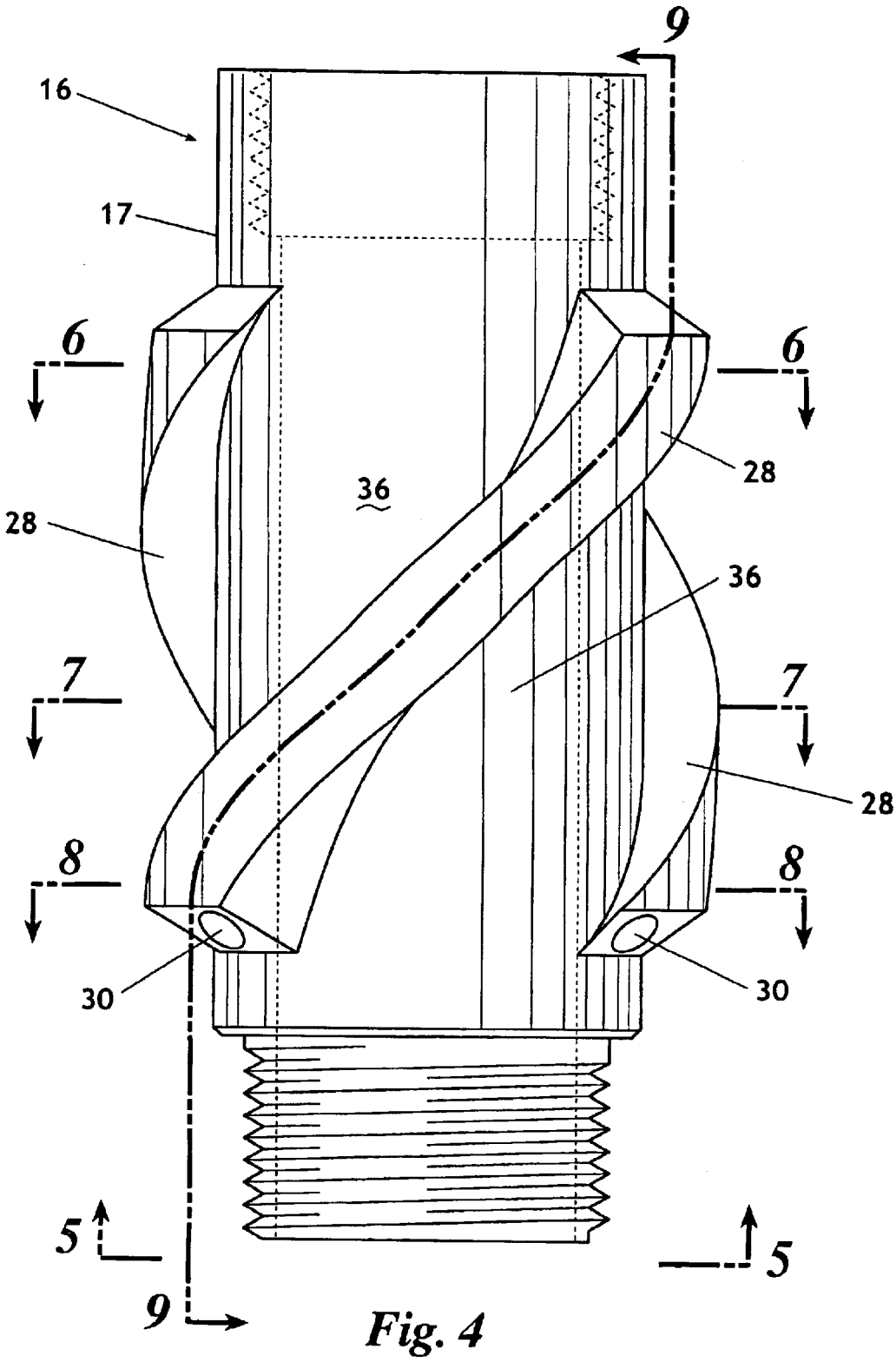
FIG. 4 is a side elevation of the injection tool by itself.

Referring to the upper portion of FIG. 2, FIGS. 3 and 4, the injection tool 16 has a generally cylindrical body 17 which is provided with a plurality (in this case, three) of flutes 28 which extend from the cylindrical body 17 and bear up against the inside of the production casing 10 as shown in FIG. 2. The flutes permit fluids passing downwardly through the outer annulus 14 to pass in a spiral direction between the flutes as shown by the arrows in FIG. 3. When the fluids pass downwardly and come against the packer 24 they must reverse direction and go upwardly through the passageways 26 which will be described in further detail.

Figure 9:
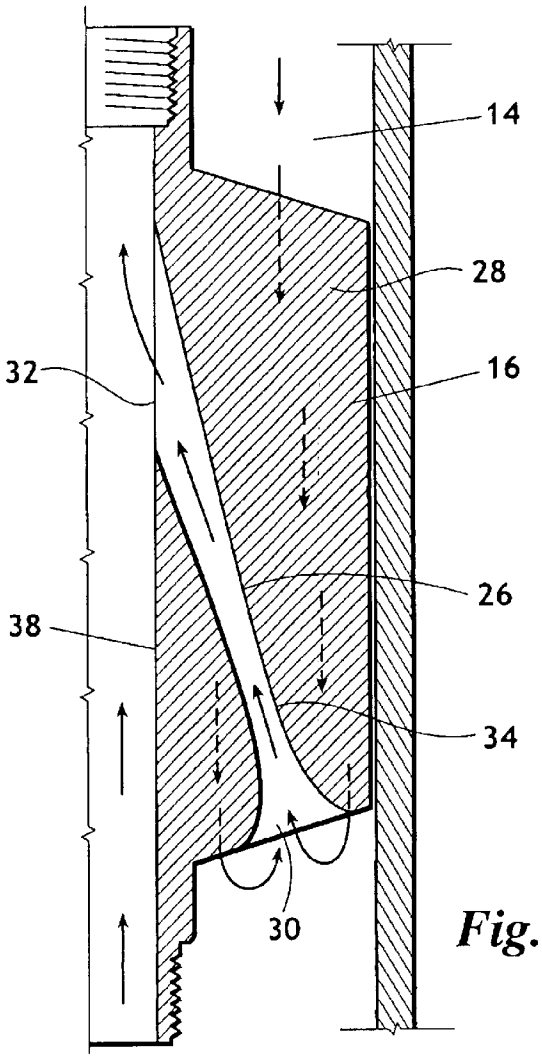
FIG. 9 is an artificial, longitudinal sectional, view of the injection tool shown in FIG. 4 taken along the curved section line 9—9 that traverses the venturi orifice of the injection tool.
Figure 5:
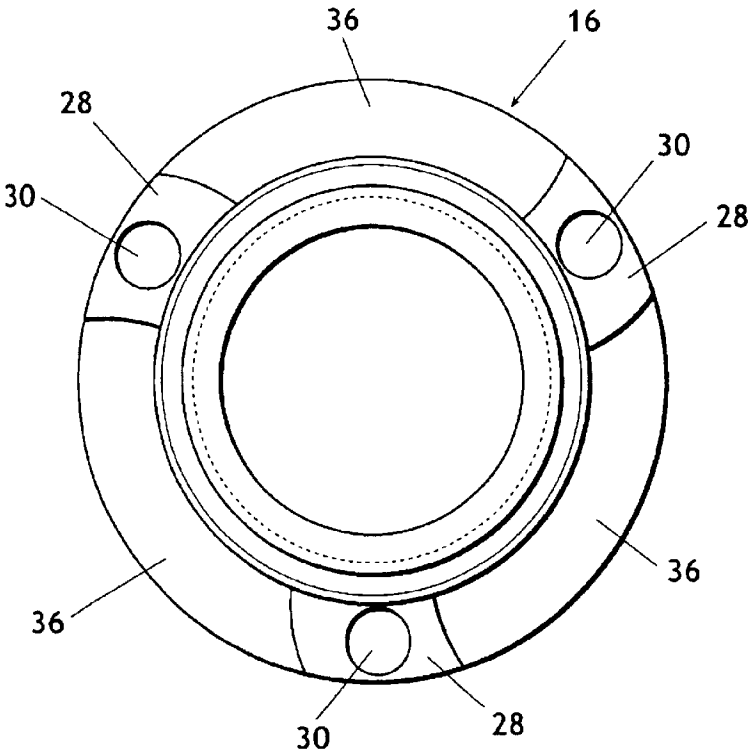
FIG. 5 is a bottom view of the injection tool shown in FIG. 4 taken along line 5—5.
Figure 6:
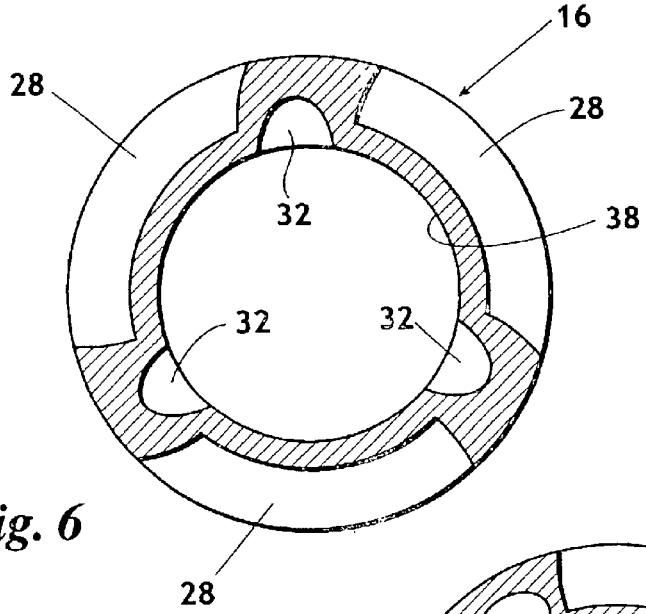
FIG. 6 is a transverse cross sectional view of the injection tool of FIG. 4 looking along section line 6—6.
Figure 7:
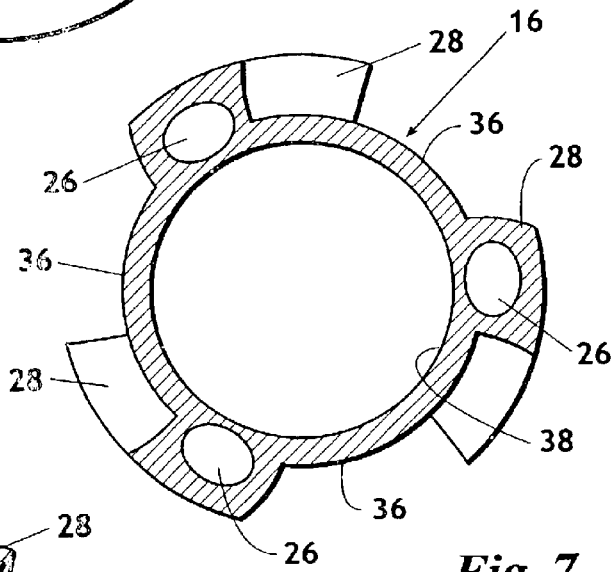
FIG. 7 is a transverse cross sectional view of the injection tool of FIG. 4 taken along section line 7—7.
Figure 8:
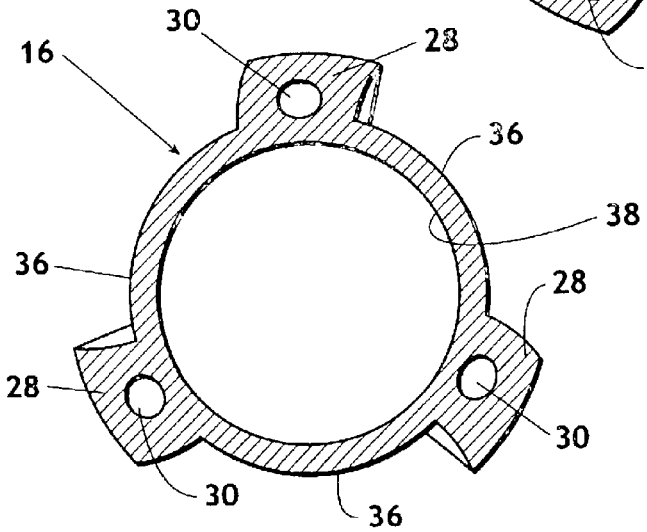
FIG. 8 is a transverse cross sectional view taken along section line 8—8 of FIG. 4.

Referring more particularly to FIG. 9, which shows the venturi passage 26 in detail, it must be remembered that this passage 26 is curved to correspond with the curved flutes or vanes 28 shown in FIG. 4. Each venturi passageway 26 has a lower opening 30 and an upper opening 32 which actually represents the inner circumference or opening of the injection tool itself. Midway between the openings 30 and 32, and nearer to the bottom of the venturi passageway 26, is a restriction 34 which represents the area of smaller cross section of the venturi passageway 26. The fluids passing through the annulus 14 will pass downwardly through the open spaces 36 between adjacent flutes until they reach the space above the packer 18, through which they cannot go. Thus, the fluids must go through the opening 30 and through the venturi passageway 26, being compressed midway in the passageway and expanding outwardly through the opening 32 into the interior or central bore 38. The use of a venturi is not new in the oil field industry. Schmidt U.S. Pat. No. 5,707,214 shows a venturi in FIGS. 6A and 6C and describes some of the actions within the venturi in FIG. 8. The present invention is different from Schmidt in many particulars. Most significantly, the present invention employs three venturies which are located in the three flutes 28 and which are spirally oriented.

There is another inner annulus 40 between the drill pipe 22 and the concentric casing 12 as well as the lower assembly 18 through which fluid flows from the area 42 upwardly around the drill pipe 22. The fluid material which passes up through the venturi openings 26 mixes with the upwardly flowing material coming through the annulus 40 (sometimes referred to as the return annulus) and assists in the upward movement of this material. Also, because the venturi passageways 26 are spirally curved to conform with the spiral shape of the flutes 28 shown in FIGS. 3 and 4, the fluids coming out of the openings 32 and into the central bore 38 of the injection tool will cause a swirling action and assist further in the upward movement of the material coming be any one of a number of acceptable alternatives including, for example, sodium lauryl sulfate, ammonium lauryl sulfate, alcohol/ether sulfates, or linear alkyl benzene sulfonates, or any other acceptable surfactant. Thus, the pressure drop created by the venturi passageways causes the surfactant to shear and generate foam, which can be used as a drilling medium to lift cuttings and fluids from the well during drilling.

What is claimed is:

1. An apparatus for under balanced drilling comprising a production casing extending vertically from the ground to the area where the drilling is taking place, a concentric casing mounted within the production casing and forming therewith an outer annulus, the concentric casing connecting at its lower end with an upper end of an injection tool, the injection tool having a lower end connecting with a packer assembly which includes a packer and slips, and a drill string having a drill bit at the lower end thereof extending downwardly through the concentric casing, the injection tool, and packer assembly to the area where the drilling is taking place, the injection tool having a generally cylindrical body and a plurality of spaced spiral flutes extending outwardly from the cylindrical body to the inner wall of the production casing and forming therebetween spiral openings through which fluid may be forced downwardly through the outer annulus and against the packer, each flute having an upwardly directed spiral passageway, the space between the drill pipe and the concentric casing forming an inner annulus for the return of drilling fluid, gas, oil, water, mud and cuttings from the drilling area upwardly to the ground, the fluid material coming down through the outer annulus going upwardly through the spiral passageways and generating a vortex where the passageways merge with the inner annulus so as to force the drilling mud, oil, gas, water and cuttings upwardly through the inner annulus, drilling mud being provided through a central bore in the drilling pipe to go downwardly into the area where the drilling is taking place.

2. An apparatus for under balanced drilling as set forth in claim 1 wherein the upwardly directed spiral passageways are shaped in the form of a venturi.

3. A method for under balanced drilling using a production casing extending vertically from the ground to the area where the drilling is taking place, the concentric casing mounted within the production casing and forming therewith an outer annulus, a concentric casing connecting at its lower end with an injection tool, the injection tool having a lower end connecting with a packer assembly which includes an expandable rubber element and slips, and a drill string having a drill bit at the lower end thereof extending downwardly through the concentric casing, the injection tool, and the packing assembly to the area where the drilling is taking place, the injection tool having a generally cylindrical body and a plurality of spaced spiral flutes extending outwardly from the cylindrical body to the inner wall of the production casing and forming therewith spiral openings through which fluid may be forced downwardly through the outer annulus and against the packer, each flute having an upwardly directed spiral passageway, the space between the drill pipe and the concentric casing forming an inner annulus for the return of drilling fluid, gas, oil, water, mud, and cuttings from the drilling area upwardly to the ground, the method which comprises passing the fluid material coming down through the outer annulus upwardly through the spiral passageways to generate a vortex where the passageways merge with the inner annulus so as to force the drilling mud, oil, gas, water, and cuttings upwardly through the inner annulus, drilling mud being provided through the central bore in the drilling pipe to go downwardly into the area where the drilling is taking place.

4. A method for underbalanced drilling as set forth in claim 3 wherein a surfactant has been added to the injection fluid and wherein the pressure drop created by the venturi passageways causes the fluids passing into the inner annulus to shear the surfactant so as to generate foam which is used to transport cuttings and fluids from the well while drilling.

* * * * *